US006281908B1

(12) United States Patent
Gibson et al.

(10) Patent No.: US 6,281,908 B1
(45) Date of Patent: Aug. 28, 2001

(54) ALIGNMENT SYSTEM AND METHOD OF COMPENSATING FOR SKEWED PRINTING IN AN INK JET PRINTER

(75) Inventors: Bruce David Gibson, Lexington; Kent Lee Ubellacker, Georgetown, both of KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/292,262

(22) Filed: Apr. 15, 1999

(51) Int. Cl.[7] ..... B41J 29/393; B41J 29/38; B41J 2/165

(52) U.S. Cl. ..... 347/19; 347/14; 347/23

(58) Field of Search ..... 347/19, 40, 41, 347/16, 14, 23, 15, 42

(56) References Cited

U.S. PATENT DOCUMENTS

| | | | |
|---|---|---|---|
| 4,364,060 | 12/1982 | Jinnai et al. . | |
| 4,424,518 | 1/1984 | Suzuki et al. . | |
| 5,049,898 | 9/1991 | Arthur et al. . | |
| 5,241,325 | 8/1993 | Nguyen . | |
| 5,250,956 | 10/1993 | Haselby et al. . | |
| 5,289,208 | 2/1994 | Haselby . | |
| 5,297,017 | 3/1994 | Haselby et al. . | |
| 5,448,269 | 9/1995 | Beauchamp et al. . | |
| 5,534,895 * | 7/1996 | Lindenfelser et al. | 347/19 |
| 5,751,305 | 5/1998 | Hadley . | |
| 5,777,638 | 7/1998 | Salter et al. . | |

* cited by examiner

*Primary Examiner*—John Barlow
*Assistant Examiner*—Charles W. Stewart, Jr.
(74) *Attorney, Agent, or Firm*—Needle & Rosenberg, P.C.

(57) ABSTRACT

A method of printing with an ink jet printer compensates for skewed printing on a print medium An image area is defined on the print medium that has a plurality of rows of pixel locations and a plurality of columns of pixel locations. A printhead includes a plurality of vertically adjacent ink emitting orifices arranged in an array having a height. The printhead is scanned during first and second scans across the print medium in a direction transverse to the advance direction. The ink is jetted onto the print medium from the ink emitting orifices during the first and second scans at selected ink dot placement locations generally corresponding to one of the columns of pixel locations An offset is determined in a transverse direction between a bottom ink dot placement location associated with the first scan and a top ink dot placement location associated with the second scan. The ink dot placement locations associated with each swath is shifted by a predetermined amount to properly align the top dots of that swath with the bottom dots of the previously printed swath.

5 Claims, 4 Drawing Sheets

Effect of Swath Position Shifting

Effect of Swath Position Shifting

ALIGNMENT SYSTEM AND METHOD OF COMPENSATING FOR SKEWED PRINTING IN AN INK JET PRINTER

BACKGROUND OF THE INVENTION

1. Field of the Invention

The present invention relates to a method of printing using an ink jet printer, and more particularly, to a method of compensating for skewed printing using an inkjet printer.

2. Description of the Prior Art

Ink jet printers typically include a printhead which is carried by a carriage assembly which is moved in transverse directions across the print medium, relative to the advance direction of the print medium within the printer. For a mono-color printhead used to jet a single color ink onto the print medium, the printhead is scanned across the print medium in one transverse direction, advanced a distance corresponding to the height of the printhead, and scanned in a return direction back across the print medium in an opposite direction. Ink is jetted from the ink emitting orifices in the printhead as the printhead scans in the transverse directions across the print medium. An image area is defined via software which overlies the print medium. The image area includes a plurality of rows of pixel locations and a plurality of columns of pixel locations. As each ink emitting orifice is scanned across an associated pixel location on the image area, a determination is made as to whether ink is to be jetted from the associated ink emitting orifice onto the print medium at the selected pixel location. By sequentially scanning the printhead across the print medium and advancing the print medium during scans a distance corresponding to the height of the printhead, ink may be selectively jetted onto the print medium at any pixel location within the image area.

One known type of error associated with ink jet printing is referred to as a "rotational error" caused by a skewed positioning of the ink emitting orifices relative to the advance direction of the print medium. Such a rotational error may result from rotational inaccuracies of the ink emitting orifices within the nozzle plate on the printhead, rotational errors of the nozzle plate relative to the remainder of the printhead, rotational errors of the printhead relative to the carriage assembly, and rotational errors of the carriage relative to the scanning axis.

A noticeable defect associated with rotational errors is an offset in the transverse direction between vertically adjacent scans of the printhead across the print medium. For example, to print a vertical line, the printhead is scanned in a first transverse direction and the ink jetting heaters are fired at selected points in time corresponding to a column of pixel locations on the image area. The paper is then advanced a distance corresponding to the height of the printhead and the printhead is scanned in an opposite direction and the ink jetting heaters are fired at selected points in time corresponding to the same column of pixel locations on the image area. Since each column of ink dot placement locations on the print medium is in fact rotationally skewed relative to the advance direction, an offset or error in the transverse direction occurs between the bottom-most ink dot placement location of the first scan and the top-most ink dot placement location of the second scan. This offset or error in the transverse direction may be objectionably perceptible to the user, depending upon the severity.

One known method of compensating for rotational errors is to advance or delay the firing times of the ink jetting heaters associated with each ink emitting orifice such that the rotationally skewed column of ink dot placement locations is rotated back to a substantially vertical orientation relative to the advance direction. However, advancing or delaying the firing time associated with each ink emitting orifice such that the entire rotationally skewed array of ink dot placement locations is rotated in one direction or the other requires a substantial amount of computational processing. Such a method therefore requires additional computing time and also may increase the cost of the machine because of the associated electrical processing hardware.

SUMMARY OF THE INVENTION

The present invention provides a method of compensating for skewed printing with an ink jet printer by shifting the position of each swath by a predetermined amount to align the top dots of that swath with the bottom dots of the previously printed swath.

The invention comprises, in one form thereof, a method of compensating for skewed printing on a print medium with an ink jet printer. An image area is defined on the print medium which has a plurality of rows of pixel locations and a plurality of columns of pixel locations. A printhead includes a plurality of vertically adjacent ink emitting orifices arranged in an array having a height. The printhead is scanned during first and second scans across the print medium in directions transverse to the advance direction. The ink is jetted onto the print medium from the ink emitting orifices during the first and second scans at selected ink dot placement locations generally corresponding to one of the columns of pixel locations. An offset is determined in a transverse direction between a bottom ink dot placement location associated with the first scan and a top ink dot placement location associated with the second scan. The position of each swath is shifted by the offset amount to align the top dots of that swath with the bottom dots of the previously printed swath. Note that the offset is a fixed value computed and loaded into memory once and used throughout.

DETAILED DESCRIPTION OF THE INVENTION

Figure 1:
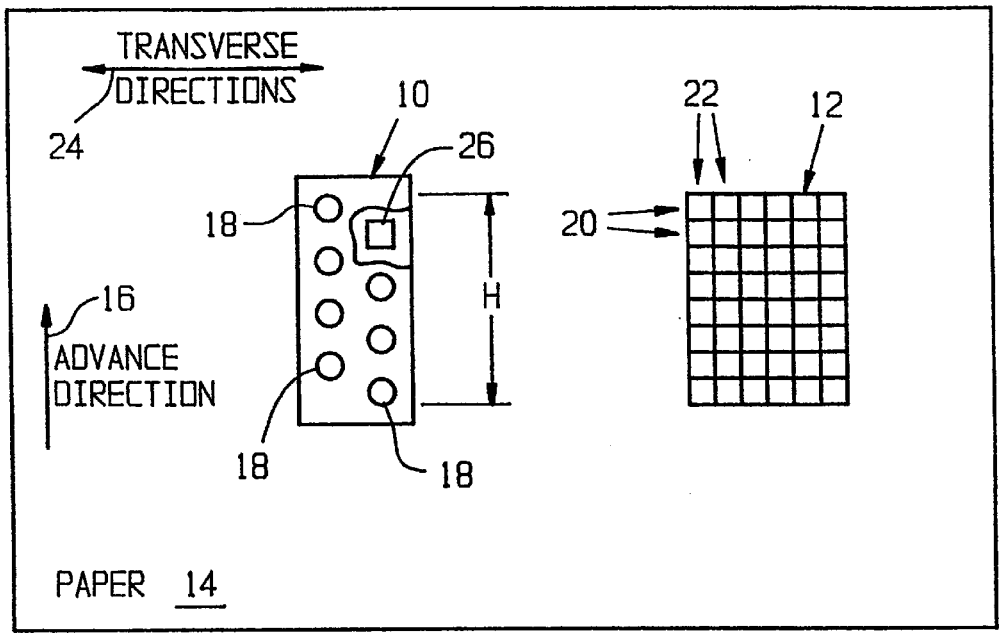
FIG. 1 is a schematic view of an exemplary printhead which may be used with the method of the present invention, shown in relationship to a portion of an image area on a print medium.

FIG. 1 shows a schematic view of an exemplary printhead 10 of an inkjet printer which may be used with the present invention, shown in relationship to a portion of an image area 12 on a print medium 14. Print medium 14 which may be a piece of paper, is movable in an advance direction within the inkjet printer, indicated by arrow 16.

Printhead 10 includes a plurality of ink emitting orifices 18 that are arranged in a vertical array. For manufacturing purposes, the vertically adjacent ink emitting orifices 18 are disposed in a staggered relationship relative to each other.

That is, the bottom ink-emitting orifice 18 shown in the right hand column is disposed vertically adjacent to the bottom ink-emitting orifice shown in the left-hand column. In the embodiment shown, printhead 10 includes eight ink-emitting orifices which are arranged in a staggered and vertically adjacent relationship relative to each other. The array of eight ink emitting orifices 18 has a height H extending from the top-most ink emitting orifice 18 to the bottom-most ink emitting orifice 18.

Printhead 10 is carried in known manner by a carriage assembly which is movable in directions transverse to advance direction 16, as indicated by double-headed arrow 24. The carriage assembly and printhead 10 may be configured for single directional printing or bi-directional printing, in known manner.

Image area 12 overlying at least a portion of paper 14 is defined in part by the vertical spacing between adjacent ink emitting orifices 18. Image area 12 includes a plurality of rows of pixel locations 20 and a plurality of columns of pixel locations 22. Each pixel location within each row 20 of pixel locations has a height that corresponds to a height of an associated ink-emitting orifice 18 on printhead 10. Moreover, in the embodiment shown, each pixel location within each column 22 of pixel locations has a width that corresponds to the height dimension of each row 20. That is, each pixel location is substantially square. However, it is also to be understood that each pixel location may have a width which differs from the height, dependent upon the addressable resolution of the stepper motor which drives the carriage assembly carrying printhead 10.

Printhead 10 includes a plurality of ink jetting heaters, one of which is shown and referenced as 26 in FIG. 1, which are respectively associated with the plurality of ink emitting orifices 18. Each ink-jetting heater is actuatable at selected points in time during a scan of printhead 10 across paper 14 to jet the ink from an associated ink-emitting orifice 18. Actuation of an ink jetting heater 26 at a selected point in time causes the rapid formation of a bubble at the base of an associated ink emitting orifice 18, thereby jetting the ink onto paper 14 in known manner.

Figure 2:
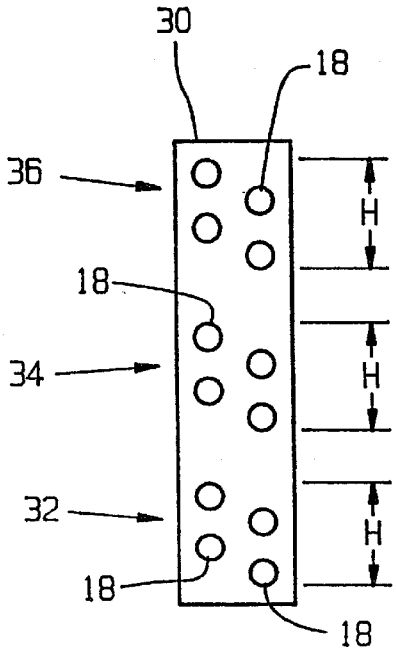
FIG. 2 is a schematic view of another exemplary printhead which may be used with the method of the present invention.

FIG. 2 is a schematic illustration of another exemplary printhead 30 that may be used with the method of the present invention. In contrast with printhead 10 shown in FIG. 1, printhead 30 shown in FIG. 2 includes three separate arrays 32, 34 and 36 of ink emitting orifices 18. Each array 32, 34 and 36 includes four ink-emitting orifices 18 which are disposed in a staggered and vertically adjacent relationship relative to each other. That is, the bottom-most ink emitting orifice 18 in the right hand column of array 32 is disposed staggered and vertically adjacent relative to the bottom-most ink emitting orifice in the left hand column of array 32. Each array 32, 34 and 36 of ink emitting orifices 18 has a common height H extending from an associate top-most ink emitting orifice 18 to a bottom-most ink emitting orifice 18. Array 32 is used to jet cyan ink onto paper 14; array 34 is used to jet yellow ink onto paper 14; and array 36 is used to jet magenta ink onto paper 14. Thus printhead 30 corresponds to a tri-color printhead used for carrying out multi-color printing. It will be appreciated that the number of ink emitting orifices 18 within each array 32, 34 and 36 may vary from that shown, and the physical position of the cyan, yellow and magenta arrays relative to each other may vary.

Figure 3:
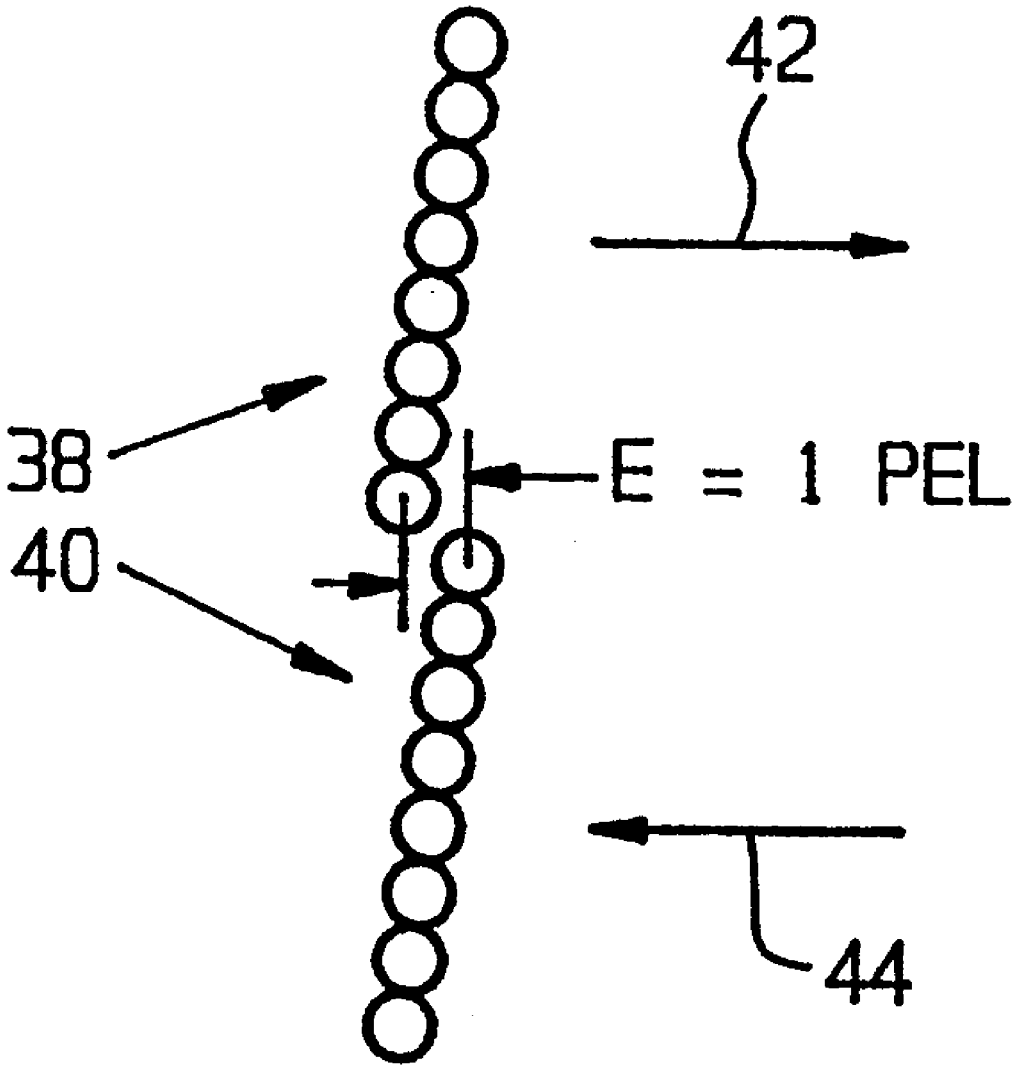
FIG. 3 illustrates an offset error between skewed columns of ink dot placement locations during first an second scans of the printhead.

FIG. 3 illustrates an offset error E between skewed columns of ink dot placement locations which are printed during adjacent scans of printhead 10 . The skewed column of ink dot placement locations 38 correspond to ink dot placement locations which are generally associated with one of the columns 22 of pixel locations in image area 12 during a first scan of printhead 10 across paper 14. Printhead 10 may be moved in a direction from left to right as indicated by arrow 42, relative to advance direction 16. A second skewed column of ink dot placement locations 40 correspond to ink dot placement locations which are generally associated with the same column 22 of pixel locations in image area 12 during a second scan of printhead 10 across paper 14. Printhead 10 may be moved in a direction from right to left during the second scan as indicated by arrow 44, relative to advance direction 16.

The skewed angular relationship of each column of ink dot placement locations 38 and 40 may result from alignment inaccuracies of ink emitting orifices 18 in the nozzle plate forming a part of printhead 10; rotational errors between the nozzle plate and printhead 10; rotational errors between printhead 10 and the carriage assembly; and rotational errors of the carriage relative to the scanning axis. Such rotational errors cause the entire column of ink dot placement locations 38 and 40 to be rotated relative to advance direction 16. This in turn causes the bottom-most ink dot placement location in skewed column 38 to be offset in the transverse direction relative to the top ink dot placement location in skewed column 40. If this offset or error E in the transverse direction exceeds a certain threshold value, the offset will be perceptible to a user. For example, in the embodiment shown, each ink dot placement location within skewed columns 38 and 40 has a corresponding pixel size associated with image area 12 of 600 dots per inch (DPI). It has been found desirable to not exceed an error E in the transverse direction of greater than one-half to one-fourth a pixel or PEL (approximately 0.000835–0.0004175 inch) so that the rotational error associated with the skewed columns 38 and 40 is not readily perceptible to a user. The maximum acceptable error may thus be expressed as a percentage of the pixel size associated with each ink dot placement location in columns 38 and 40. Although a pixel size of 600 DPI is shown in FIG. 3, it will also be appreciated that other pixel sizes may be used with the method of the present invention (e.g., 300 DPI at 0.00333 inch). Moreover, the acceptable percentage of offset or error E may vary dependent upon the particular application.

Figures 4A, 4B:
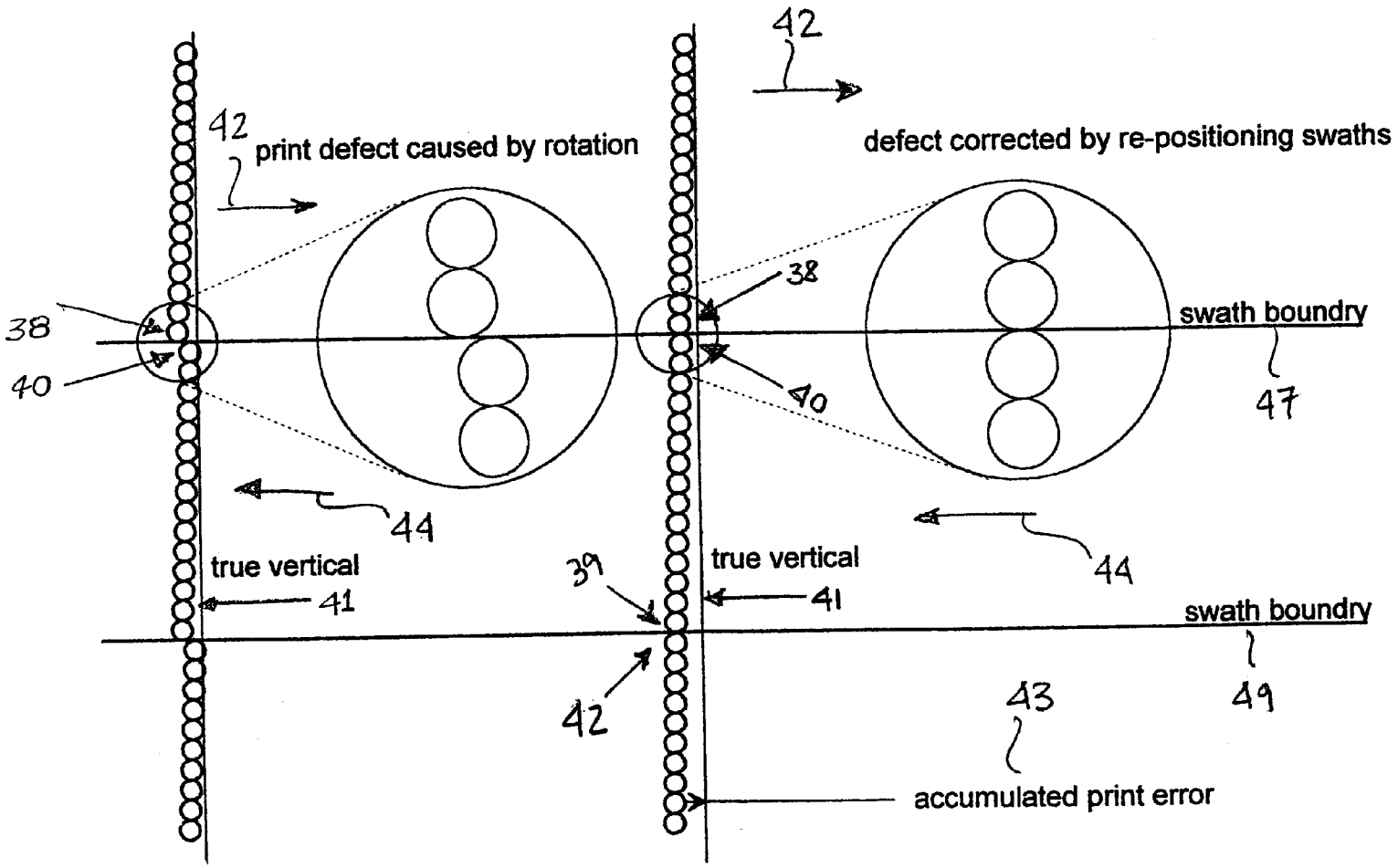
FIG. 4 illustrates one embodiment of the method of the present invention for compensating for the skewed columns of ink dot placement locations shown in FIG. 3.

Referring now to FIG. 4, there is shown an illustration of one embodiment of method of the present invention for compensating for the skewed columns of ink dot placement locations shown in FIG. 3. The left row of pixels shown in FIG. 4A is an illustration like in FIG. 3 of skewed columns of ink dot placement. The true vertical positioning is shown by line 41. The right row of pixels shown in FIG. 4B illustrates one embodiment of method of the present invention. The position of each swath is shifted by a predetermined amount to properly align the top dots of that swath with the bottom dots of the previously printed swath. Referring to FIG. 4B, at swath boundary 47, ink dot placement location in column 40 is placed directly below the ink dot placement location in column 38. The shifting of swath position is accomplished by advancing or delaying the starting point of each swath, based on the PEL and delay counters of the printer. The delay counters have very fine resolution allowing for fractional dot shifting of the swath.

The amount of position shift adjustment would be cumulative from one swath to the next, causing the entire print to appear defect free. As shown in FIG. 4B, at swath boundary 49, pixel location 42 is shifted twice the amount that pixel location 40 was shifted. This causes pixel location 39 to be aligned with pixel location 42. This invention hence makes the misalignment less noticeable to where it may not be perceived by the human eye.

Because of the present manufacturing tolerances of alignment, the total amount of print misplacement generated down the page, due to the accumulated positional shifting, will be minor. For example, if a continuous six inch image were printed using a 0.5 inch print swath at a 0.001 inch rotational alignment error level, the total accumulated print position offset would be less than $1/80^{th}$ of an inch.

Figure 5:
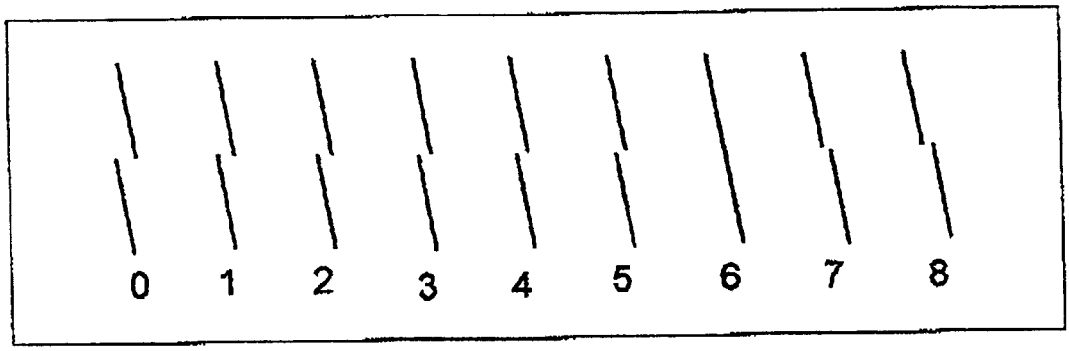
FIG. 5 illustrates one method to determine the amount of correction.

The amount of correction can be determined either by manual or automatic means contained within the printer. One method of manual implementation is to present the user with an alignment pattern as shown in FIG. 5. The alignment pattern associates various number selections and requiring the correct selection to be input as a value which will be stored within the driver and possibly the printer as well. This technique is similar to current bidirectional and color/monochrome alignment methods used today.

One example of the alignment pattern is shown in FIG. 5. The top row of slanted lines represents one transverse swath of the printhead. Each line is a full printhead height. The exaggerated slant represents the rotation error. Below the top row is a second similar traverse swath printed in the same direction as the first with varying degrees of offsets for each vertical line as described previously. The user is instructed to pick the number that yields the straightest composite line. This number is then stored in the printer driver and/or printer hardware for calculations needed to make the timing corrections as a function of paper advancement. Note, in FIG. 5, if no rotation error were present, the center selection, line number 4, would be the correct choice. With the rotation error illustrated, the correct value shifts to line number 6. The maximum amount of rotation error expected, offset timing resolution available and perceivable delectability of the rotation error dictates the actual number of choices available. Patterns like that shown in FIG. 5 can be developed to help increase both human and automated sensitivity to slight rotational errors.

The conditions of a dual printhead (color and monochrome) are considered. For monochrome only printing, position shift on single pass printing. Even highly shingled patterns will benefit from compensation in the form of crisper lines. If a reduction in print position offset is desired, position shift when gaps of white (no print) occur between swaths.

For color only printing, compensation is not required since due to the swath size and shingling requirements, the error is only one sixth that of the full mono swath. Both color and monochrome printing must remain aligned so the ending shift position is maintained and no positional shifting is required unless a white space occurs between the swaths.

For color and monochrome printing, compensation is not required or desired. During this type of printing, both the mono and color heads are shingled, reducing the misalignment error. As for color only printing, the ending shift position should be maintained and position shift only if a white space occurs between swaths. Note that the amount of positional shifting should be the same for color and monochrome printing.

While the invention has been described in detail with specific reference to preferred embodiments thereof, it is understood that variations and modifications thereof may be made without departing from the spirit and scope of the invention.

What is claimed is:

1. A system for compensating for skewed printing on a print medium with an ink jet printer, the print medium being movable in an advance direction in the ink jet printer, said system comprising:

(A) a printhead including a plurality of ink emitting orifices, said plurality of ink emitting orifices being arranged in an array, said array of ink emitting orifices having a height;

(B) means for jetting ink onto the print medium as the printhead is scanned across the print medium in a direction transverse to the advance direction, the ink being jetted from the ink emitting orifices at selected ink dot placement locations to form a swath of ink dots having a top ink dot and a bottom ink dot from each scan;

(C) means for advancing the print medium in the advance direction a distance corresponding to the height of said array of ink emitting orifices;

(D) means for determining an offset in the transverse direction between a bottom ink dot of a first scan and a top ink dot of a second scan, wherein the second scan immediately follows the first scan; and (E) means for aligning the top ink dot of the second scan with the bottom ink dot of the first scan by shifting the swath of the second scan in an amount depending upon the offset in the transverse direction away from a vertical direction wherein subsequent swaths to the second swath are shifted by applying the determined offset thereto in relation to an immediately proceeding swath.

2. The system of claim 1, wherein the offset is cumulative from one scan to the next.

3. The system of claim 1, wherein the means for jetting ink comprises one of a black ink, cyan ink, yellow ink and magenta ink.

4. A method of compensating for skewed printing on a print medium with an ink jet printer, the print medium being movable in an advance direction in the ink jet printer, said method comprising the steps of:

(A) providing a printhead including a plurality of ink emitting orifices, said plurality of ink emitting orifices being arranged in an array, said array of ink emitting orifices having a height;

(B) scanning said printhead in a first scan across the print medium in a direction transverse to the advance direction;

(C) jetting ink onto the print medium from said ink emitting orifices during said first scan at selected ink dot placement locations to form a swath of ink dots having a top ink dot and a bottom ink dot;

(D) advancing the print medium in the advance direction a distance corresponding to the height of said array of ink emitting orifices;

(E) scanning said printhead in a second scan across the print medium in a direction transverse to the advance direction;

(F) jetting ink onto the print medium from said ink emitting orifices during said second scan at selected ink dot placement locations to form a swath of ink dots having a top ink dot and a bottom ink dot;

(G) determining an offset in the transverse direction between a bottom ink dot of the first scan and a top ink dot of the second scan;

(H) aligning the top ink dot of the second scan with the bottom ink dot of the first scan by shifting the swath of the second scan in an amount dependent upon the offset in the transverse direction away from a vertical direction to form a substantially continuous swath; and (I) printing on the print medium along the continuous swath wherein subsequent swaths to the second swath are shifted by applying the determined offset thereto in relation to an immediately proceeding swath.

5. The method of printing of claim 4, wherein the ink comprises one of a black ink, cyan ink, yellow ink, and magenta ink.

* * * * *